United States Patent [19]

Marshall

[11] 4,334,330

[45] Jun. 15, 1982

[54] BEDSIDE COMMODE

[76] Inventor: Arthur K. Marshall, 149 N. Carmelina Ave., Los Angeles, Calif. 90049

[21] Appl. No.: 203,278

[22] Filed: Nov. 3, 1980

[51] Int. Cl.[3] ..... A47K 11/06; A61G 7/02

[52] U.S. Cl. ..... 4/480; 4/450; 4/476; 4/457; 5/90

[58] Field of Search ..... 4/480, 476, 456, 451, 4/254, 450, 483, 454, 484, 479; 5/90

[56] References Cited

U.S. PATENT DOCUMENTS

| | | | |
|---|---|---|---|
| 557,614 | 4/1896 | Schmitt | 4/480 X |
| 735,135 | 8/1903 | McLennon | 4/480 X |
| 2,204,343 | 6/1940 | Dawson | 4/480 |
| 3,014,224 | 12/1961 | Hall | 5/90 |
| 3,050,741 | 8/1962 | Coleman | 4/480 |
| 3,729,749 | 5/1973 | Rosecrans | 4/456 X |
| 4,011,610 | 3/1977 | Parker | 5/90 |
| 4,207,633 | 6/1980 | Smith et al. | 5/90 |
| 4,295,232 | 10/1981 | Marshall | 4/457 X |

*Primary Examiner*—Henry K. Artis

*Attorney, Agent, or Firm*—Romney, Golant, Martin, Disner and Ashen

[57] ABSTRACT

A bedside commode carried on a mobile frame including a ramp for bridging the space between the bed and the commode, and a peripheral railing mounted to extend above the commode platform for providing a protective barrier as well as a gripping bar for the patient. A front railing with a raised lateral portion is mounted in a fixed position on the forward edge of the commode platform. At least one side railing is manually movable from an upright locked position to an unlocked lower position below the upper surface of the commode platform, and the preferred embodiment also includes a rigidly mounted side railing opposite the manually movable side railing.

16 Claims, 6 Drawing Figures

BEDSIDE COMMODE

This invention relates generally to bedside commodes for patients who are confined to hospital or convalescent beds, and more specifically to a mobile bedside commode which can be removably secured adjacent the side of a bed and which has peripheral railings around the commode platform to protect the patient against falling while at the same time enabling the patient to pull himself back and forth between the bed and the commode with little or no assistance.

Generally speaking, prior art bedside commodes have been excessively complicated in construction and have not imaginatively provided a simple, inexpensive device which can be safely used by a bed-ridden patient without the assistance of a nurse or other person. In this regard, it is highly desirable for hospital efficiency as well as for the physical and emotional well-being of a patient to provide a bedside commode which enables a patient partially immobilized, such as with arm, leg and/or body casts, to be able to traverse back and forth from the bed to the commode independently without having to call for assistance which may not be immediately available.

Thus, the present invention contemplates the use of a simple frame-mounted commode which can be moved on wheels or the like from room to room for positioning adjacent the bed of a patient unable to transport himself to conventional toilet facilities.

It is an object of the invention to provide a ramp along the back edge of a commode platform which forms a solid and secure bridge to the top of the bed mattress. A related object is to provide a ramp pivotally attached to the platform for movement from an upright storage position to a laterally extended position inclined upwardly, downwardly, or on the level in order to rest on top of the adjacent bed surface. The commode will preferably be of a height which will cause the platform and ramp to be substantially level with the top of a standard hospital bed.

It is a further object of the invention to provide a railing extending around the periphery of the commode platform to prevent the patient from falling to the floor and to provide a gripping surface for use by the patient while using the commode as well as traversing back and forth from the bed.

It is another object of the invention to provide a bedside commode with the aforementioned characteristics including a front railing bar permanently mounted in upright position and which has a central raised portion over a toilet cutout in the platform to facilitate the positioning of the legs under the front bar during use of the commode. A related object is to provide an improved front railing which connects to the commode platform through a single upright support bar displaced from the toilet cutout.

An additional object of the invention is to provide a device which the aforementioned characteristics which includes separately constructed side railings with at least one side railing manually moveable by the patient from a lowered unlocked position into an upright locked position. A related object is to have one side railing permanently fixed in place providing a holding surface where the patient swings his body onto the commode platform from the opposite direction.

Additional objects, purposes, and advantages of the invention will be evident to those skilled in the art in view of the preferred embodiment of the invention illustrated in the accompanying drawing and described in detail hereinafter.

Figure 1:
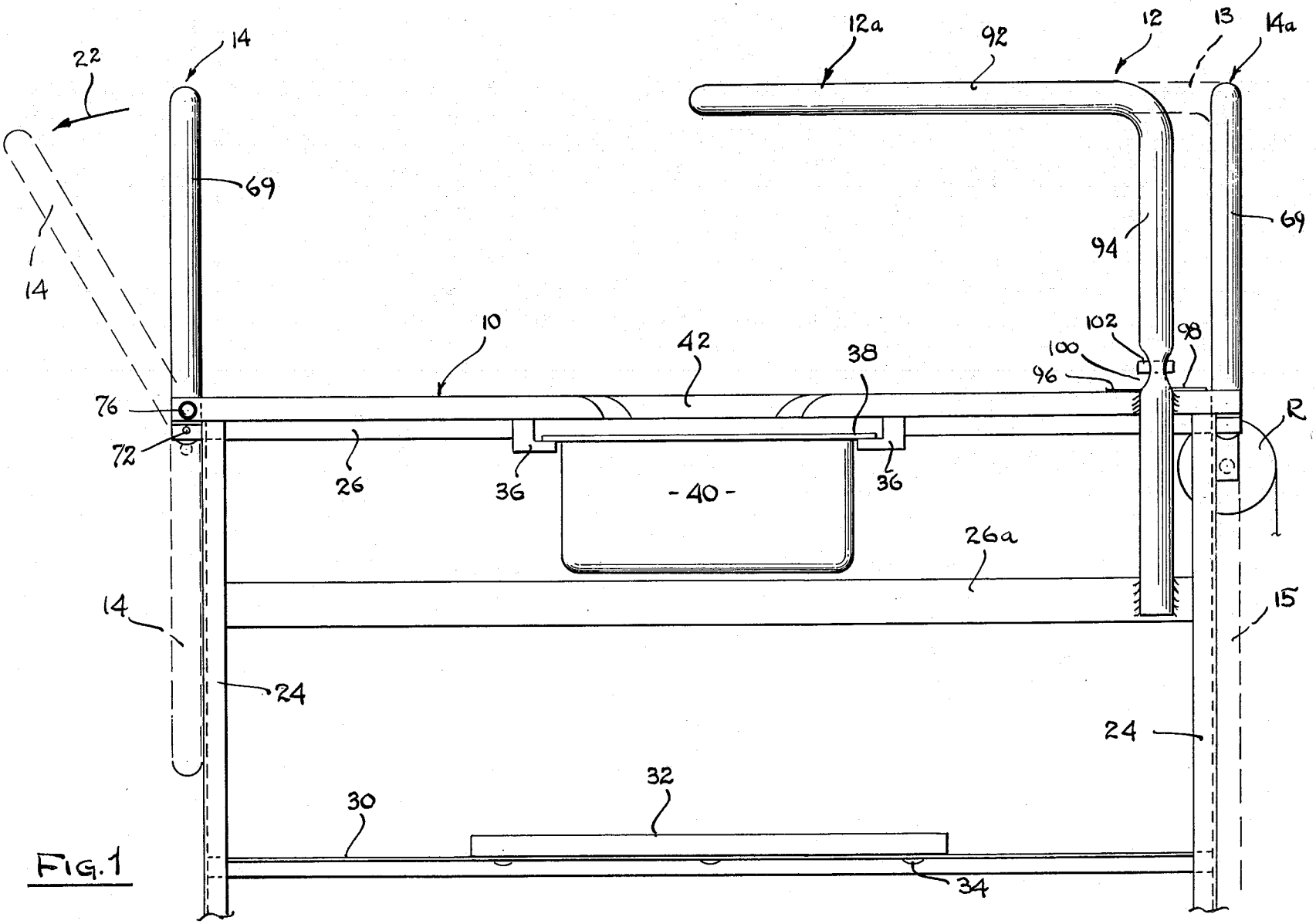
FIG. 1 is a front elevational view of a presently preferred embodiment of the invention with a front railing bar having an L-shaped or elbow configuration fastened to the commode on one side, and a fixed side rail adjacent thereto.
Figure 2:
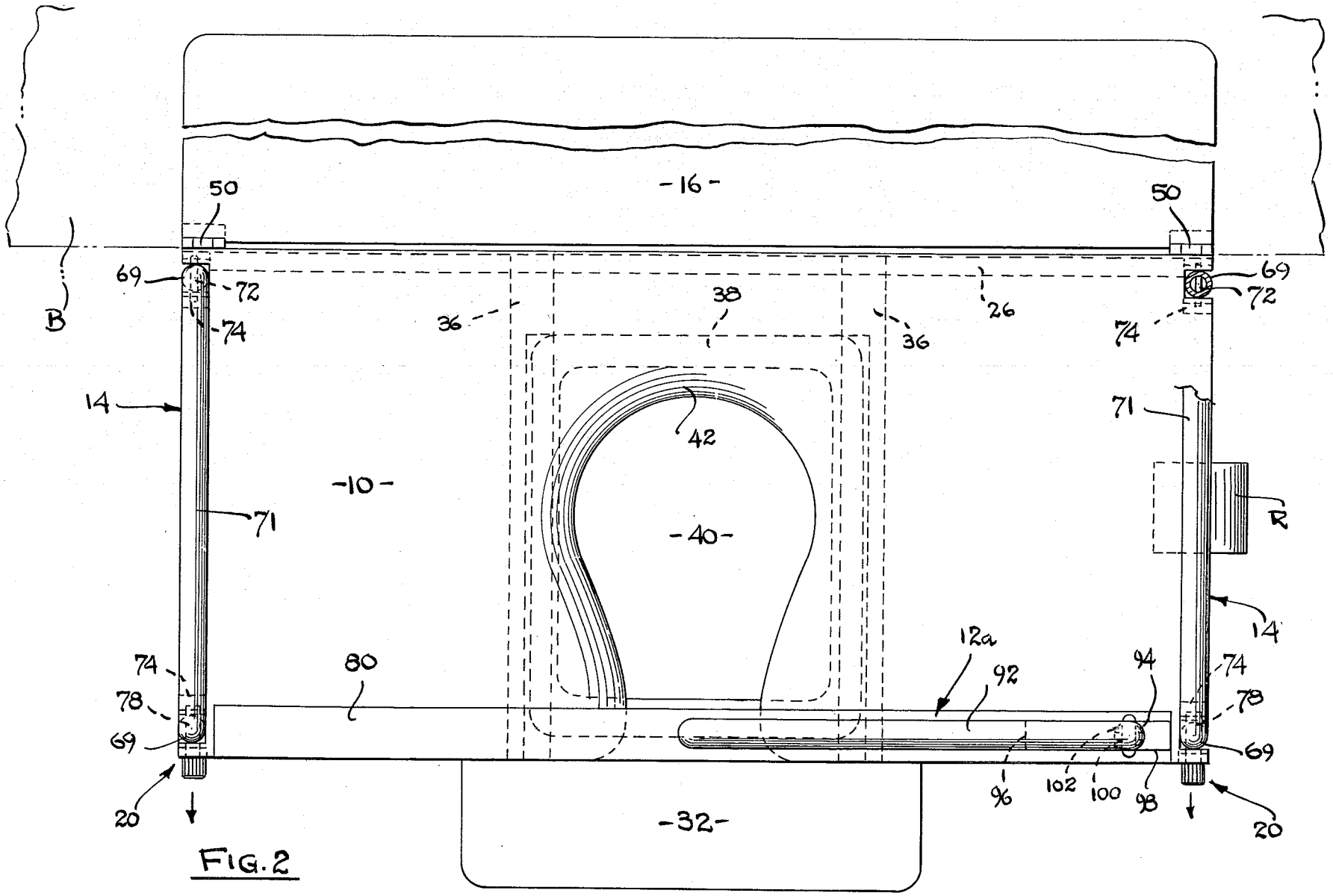
FIG. 2 is a top plan view of the embodiment of FIG. 1, showing pivotal mountings for both side rails.

Generally speaking, the invention includes a commode platform 10 having peripheral railings formed by a front railing 12 and two side railings 14, with a ramp 16 hingedly mounted on the back edge of the platform for pivotal movement as shown by arrow 18. Thus, the ramp 16 provides a bridge from the commode platform to a bed B, even though the bed may be above, level with or lower than the commode platform. The front railing 12 is permanently affixed to the platform. In the presently preferred embodiment of FIG. 1, one of the side railings is also permanently affixed in its upright position so that it is always available as an upstanding gripping surface for the patient. At least one of the side railings 14 is pivotally mounted on the platform to enable it to be separately moved from an upright locked position, where it is secured by a retractable lock 20, to a lower unlocked position by manual rotation of the side railing as shown by the directional arrows 22. This enables a patient to use either the left and right side railings to pull himself onto the platform, or alternatively to lower at least one side railing as for a patient with a leg cast which requires barrier-free clearance along a side edge of the platform. This basic structure is inexpensive to build but is sufficiently sturdy and reliable to enable a patient to acquire a self reliance and independence as well as maintain his privacy in the course of his hospitalization or convalescence, as described in more detail hereinafter.

The underlying support structure for the commode includes a pair of rectangular end frames 24 each suitably enforced as with an X-brace 25 and joined by one or more longitudinal crossbars 26. Wheels 28 or the like are inserted on the bottom of the frame 24 and may be provided with conventional clamping devices (not shown) to stabilize the commode when it is not being transported from place to place. Midway up the front of the frame is mounted a longitudinal angle iron 30 which carries a foot rest 32 suitably attached hereto as by screws 34. The frame also includes lateral slide members 36 extending across the frame from one of the crossbars 26 and attached underneath the platform 10 for receiving flanged edges 38 of a portable toilet bowl 40. This prevents toilet bowl from sliding out from under patient. These lateral angles 36 are mounted to be offset from a toilet cutout 42 located in the middle of the platform and along the front edge thereof in conventional fashion.

In order to facilitate the positioning of the commode adjacent the bed, any conventional fastener member can be utilized, such as a rope 44 mounted on one of the crossbars 26 and threaded through a one way friction locking member 46 to enable easy securing of the frame structure adjacent the bed by pulling the rope in the direction of arrow 48.

If desired, a toilet roll R may be mounted directly on one side of the commode as shown in the drawing.

It will be understood by those skilled in the art that the aforementioned support structure for the platform, railings and ramp can be modified by using specifically different components from those shown in the illustrative embodiments.

Referring more specifically to the combination of components of the platform, ramp and railings constituting the improvement of the present invention, it is preferable that the ramp 16 is a solid rectangular member which extends along the full length of the back edge of the platform and is connected thereto by one or more hinges 50. Also, the ramp should be sufficiently wide to provide a solid stable support for a patient crawling or pulling himself between the bed and the commode platform. In addition, the ramp is designed to be pushed into upright position off the bed, if desired, when the commode is not in use. The hinged marginal edge of the ramp is preferably made level with the adjacent surface of the platform, and providing additional width in the ramp member also enables the commode to be used with raised or lowered beds without creating a sharp incline or decline of the ramp.

The railings 12, 14 and 14*a* are preferably built of large heavy gauge tubular material to facilitate their use as a barrier for the safety of the patient, as well as to provide sufficient strength and diameter to be used as a gripping surface and handle by the patient. Referring to the FIG. 1 preferred embodiment, the front railing 12*a* constitutes a separate bar permanently attached to one side of the commode, or alternatively, an integral extension from the adjacent side railing 14*a* as shown by dotted lines 13. In both instances, both railings 12*a*, 14*a* are solidly affixed to the platform and/or frame to provide sufficient strength and stability to withstand the manual stress applied by a patient using the commode. When front railing 12*a* is constructed separately, it is in the shape of an elbow bar comprising horizontal portion 92 and upright portion 94, and is mounted on one side of the front of the commode as at 98 on FIG. 1. The horizontal portion 92 extends toward the central portion and along the front edge of the commode. The upright portion 94 may be conventionally mounted to base plate 80 extending along the front of the commode. If greater support is required, upright portion 94 may be flattened to allow angle irons 96 and 98 to be used in connection with bolts 100 and 102 to add further rigidity to the mounting and/or extended down to be suitably fastened to a cross bar 26*a* for additional strength and stability. Elbow bar 12*a* is especially desirable if the condition of the patient is such that he would find it difficult to maneuver his legs around any upright members 82 of the alternate embodiment of T-bar 12*c* (see FIG. 5) or between both vertical leg portions 58 of the alternate embodiment of the inverted U-shaped bar 12*b* (see FIGS. 3, 4 and 4*a*). Elbow bar 12*a* allows the patient to grab upright portion 94 or horizontal portion 92 and swing his legs over the commode without impediment.

When the front L-shaped railing constitutes an integral extension 13 from the fixed side railing 14*a*, a side railing leg 69 may be extended downwardly along the frame for additional stability, as shown by dotted line 15.

The side railings 14, 14*a* may take a variety of shapes, but in the exemplary embodiments are shown as inverted U-shaped railings having legs 69 joined through curved junctions 70 to a horizontal arm 71. At least one of the side railings has legs 69 pivotally connected to the platform at their ends by means of pivot pins 72 mounted on brackets 74 attached to the underside of the platform 10. A manually releaseable lock for holding the side railing in its normally upright position is shown in the exemplary form as constituting a handle 76 attached to a high strength locking pin 78 which may include a biasing spring member (not shown) which would automatically push the pin through a matching slot in the leg 69 when the side railing is manipulated to a vertical position. The thickness of the bar and the location of the pivot pin and mounting brackets are designed such that when the side railing is moved to an unlocked lowered position (shown in phantom), both the mounting brackets and the bar itself will be below the surface of the platform to facilitate the passage of a patient's arm, leg or body across and along the edge of the platform without any protruding obstruction.

Figure 3:
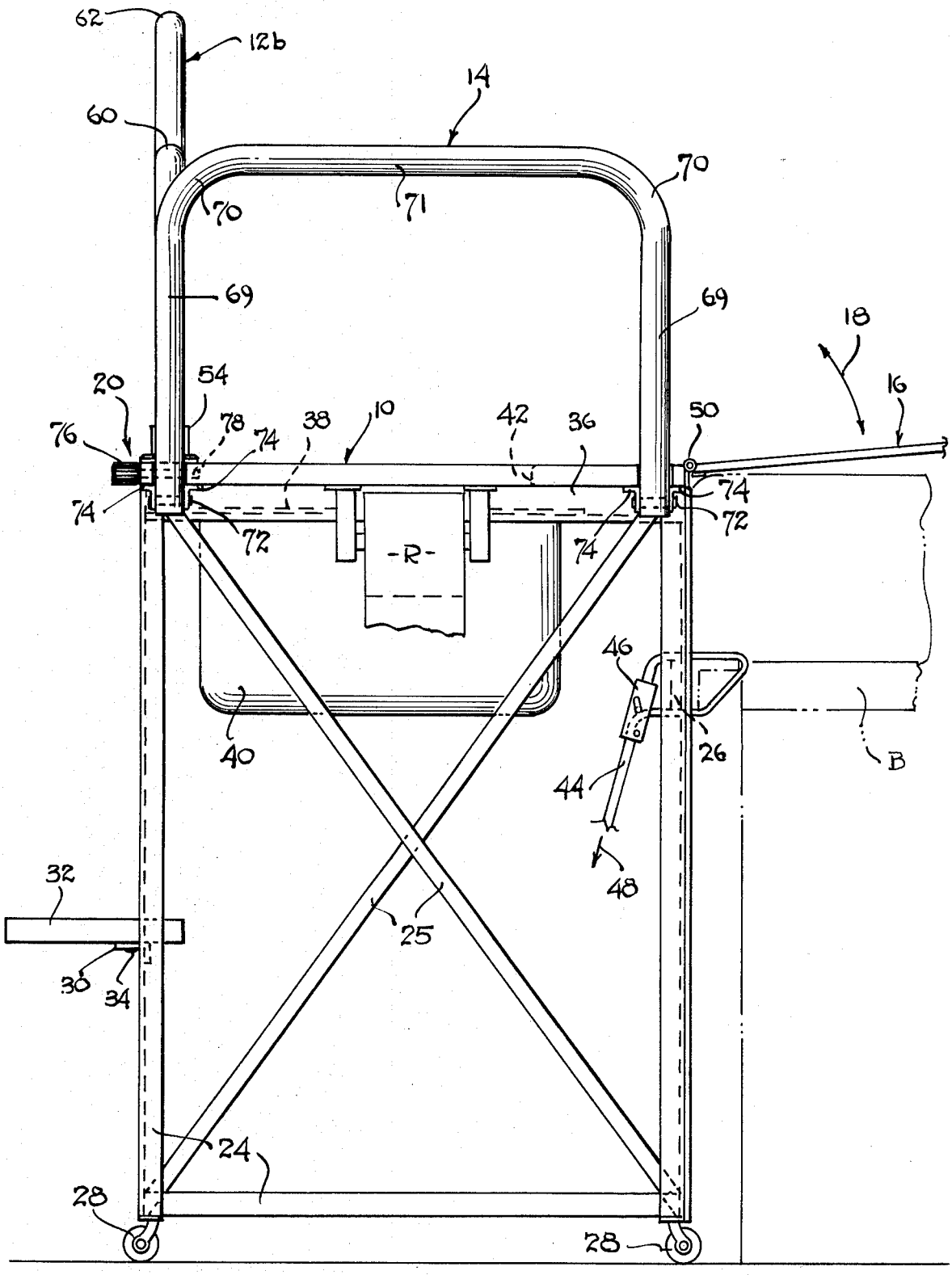
FIG. 3 is a side elevational view of a bedside commode attached to a bed shown in phantom line and showing an alternate embodiment with an inverted U-shaped front railing.
Figure 4:
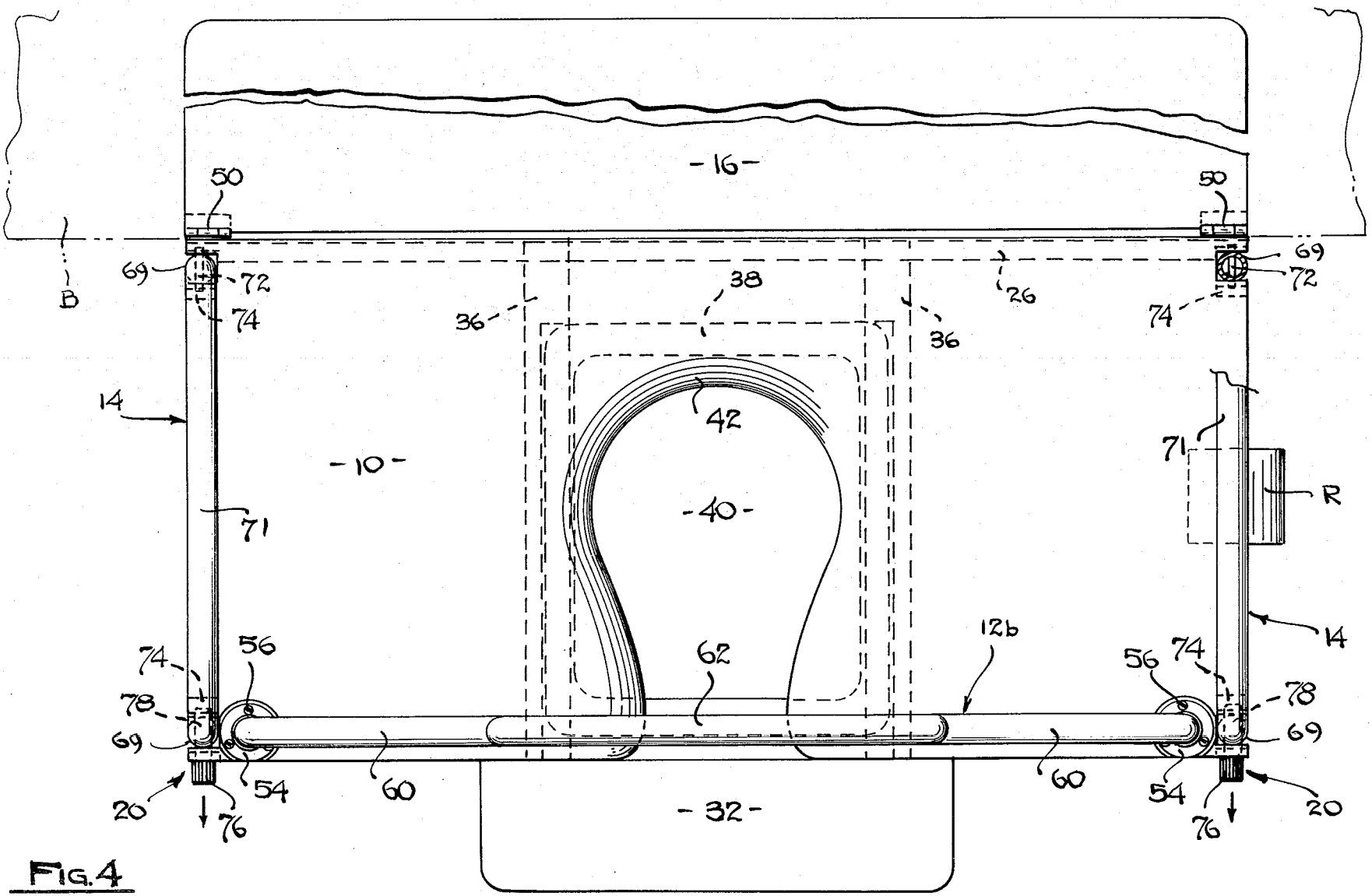
FIG. 4 is a top plan view of the embodiment of FIG. 3 with a portion cut away to show the pivotal mounting of a side rail on the platform.
Figure 4A:
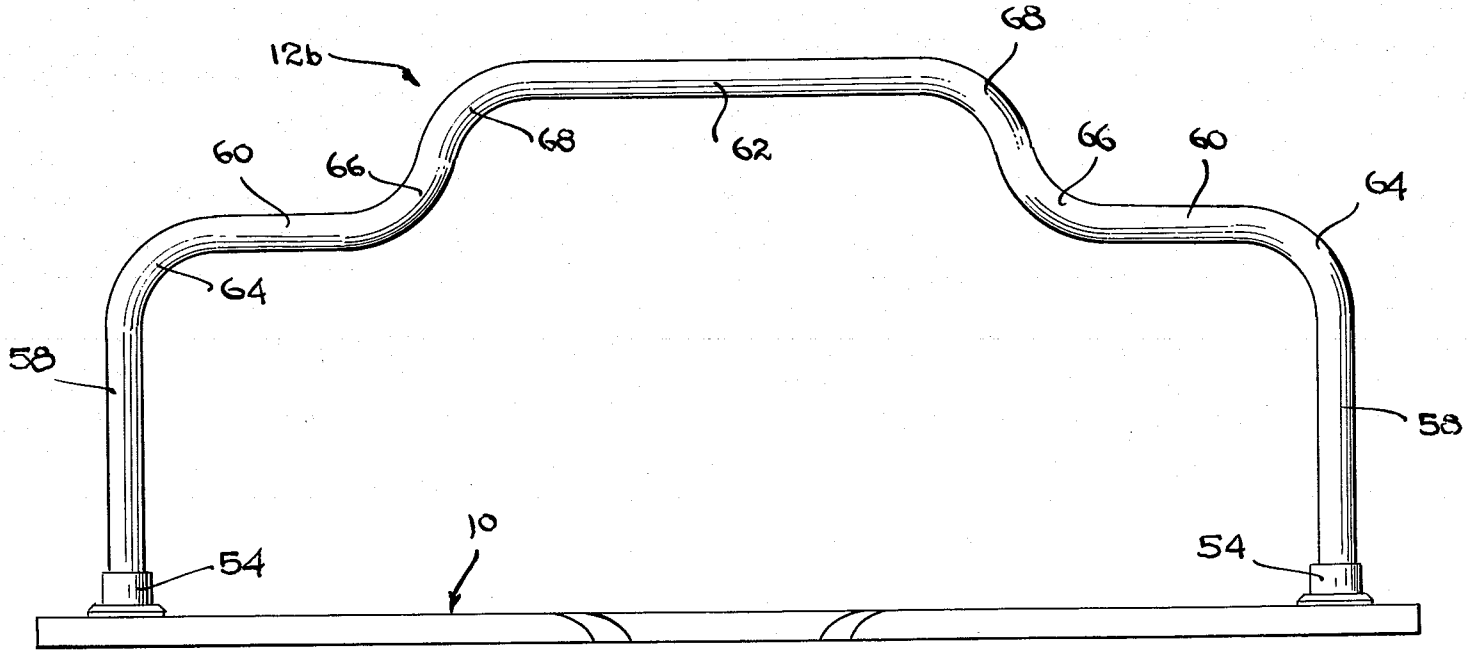
FIG. 4A is front elevational view of the front railing bar of FIGS. 3 and 4.

In the alternate embodiment of FIGS. 3, 4 and 4*a*, a double-mounted front railing 12*b* is permanently attached through both its ends to the platform by heavy duty flanged fittings 54 securely connected to the platform as by bolts 56. The front railing includes vertical leg portion 58 horizontal side portion 60 and a central raised portion 62 which is positioned over the footrest 32 and the toilet cutout 42. Thus, a patient can use any portion of the front railing 12*b* including its exterior junctions 64 and interior junctions 66 and 68 as curved or straight gripping surfaces to push or pull in virtually any direction as required in the course of transporting himself back and forth across the ramp during use of the commode.

Figure 5:
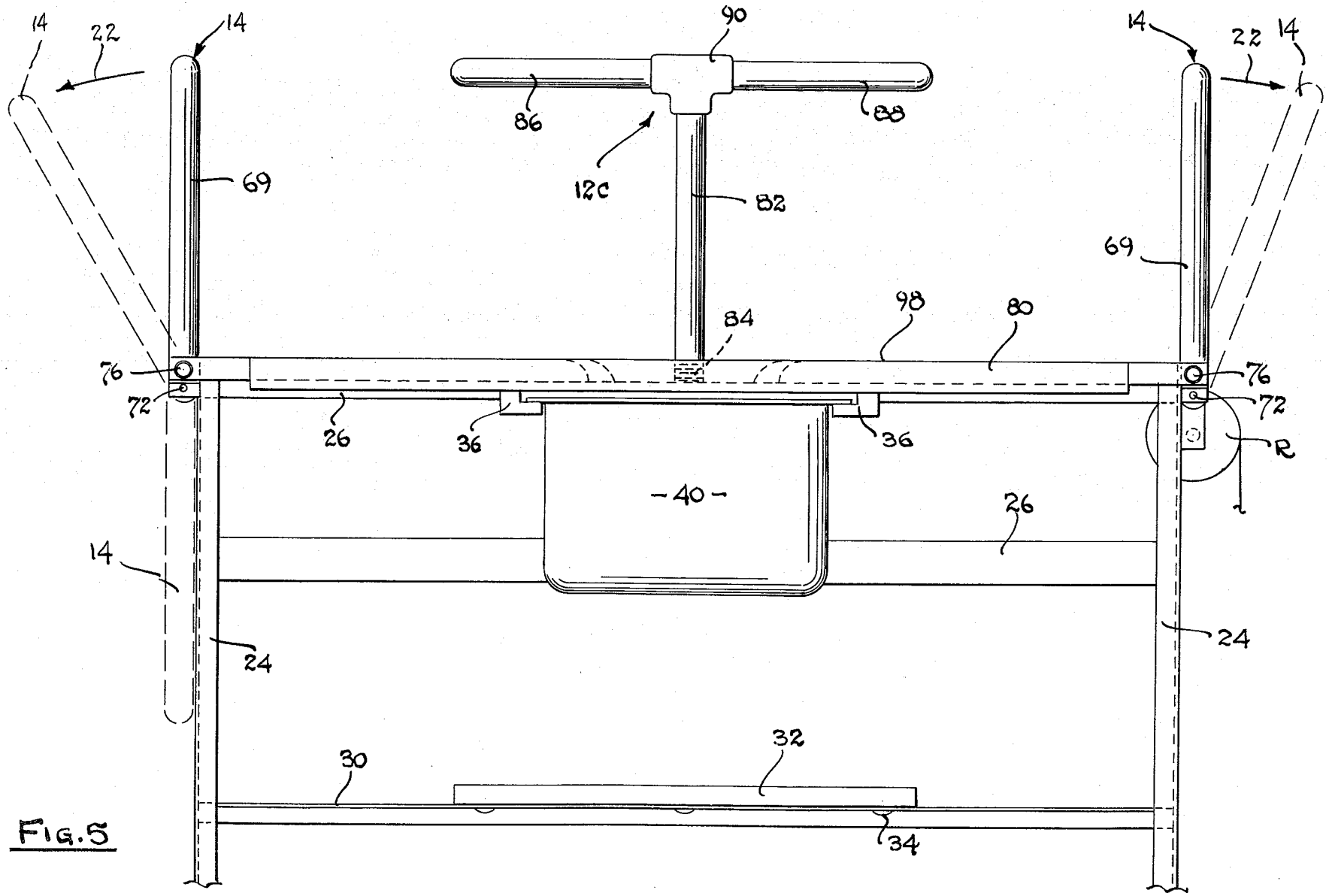
FIG. 5 is a front elevational view of an alternate embodiment showing a T-shaped front railing.

In the alternate embodiment of FIG. 5, the present invention includes a modified front railing in the form of a T-bar 12*c* which is suitably mounted to the frame or platform such as to a large solid bar or base plate 80 extending along the front of the commode. The T-bar includes an upright section 82 solidly mounted to the base plate 80 through a conventional connector such as a matching threaded slot 84. The base plate is mounted along the front of the platform by conventional fasteners such as brackets (not shown). The upper end of the upright 82 carries oppositely extending arms 86, 88 which are joined through a coupling 90 to the top of the upright 82. Although the upright specifically shown in the drawing is perpendicular to the platform, the upright member 82 may be mounted in a non-vertical position to provide forward and/or lateral tilting in order to facilitate its optimum positioning for gripping by the patient while minimizing interference with his leg movements. This embodiment is specifically designed for persons who have broken legs and the like and therefore have difficulty manipulating or bending their legs. As will be seen in the drawings, the base plate to which the T-bar is fastened is positioned along the front of the commode platform so that its width and its height dimensions do not cause any protrusion or other obstacle to a patient as they slide their legs around and under the T-bar. The final sitting position of the patient is straddling the upright portion of the T-bar.

It will be clear from the foregoing description of the illustrated embodiments that the unique combination of the railings and ramp structure positioned and mounted on the commode platform enable patients having various physical maladies to pull, push, crawl or otherwise transport themselves along a variety of barrier-free paths in order to transport themselves from the bed to the commode, use the commode, and return back to the bed in relative safety utilizing whichever muscles and limbs are free and available and dragging along whatever portion of the body is incapacitated by encasement in a cast or the like without assistance from a nurse.

Although several exemplary embodiments of the invention have been disclosed for illustrative purposes, it will be understood that various changes, modifications, and substitutions may be incorporated in such embodiments without departing from the invention as defined by the claims hereinafter.

I claim:

1. A mobile bedside commode which is removably attachable to a bed of a patient, comprising in combination:

a frame structure;

a platform attached to said frame structure, said platform including a toilet cutout and means for holding a toilet bowl underneath said cutout;

peripheral railing means attachably connected to said platform and extending upwardly therefrom along the front and side edges of said platform for preventing the patient from falling from said platform seat and for providing a gripping handle for the patient; and ramp means connected to and extending laterally from the back edge of said platform to provide a bridge between said platform and the bed, to allow the patient to move with minimal or no assistance back and forth between the bed and said commode.

2. The device of claim 1 wherein said ramp means extends along the full length of the back edge of said platform, and includes hinge means attached to said platform for movement of said ramp to an upwardly sloping, horizontal, or declining position for resting on beds which are respectively above, level with or below said platform.

3. The device of claim 1 wherein said peripheral railing means includes:

fixed front railing means attached through upright means to said platform for making a protective barrier along the front of the platform; and pivotal side railing means attached to said platform and manually movable between a first upright position for making a protective barrier along the side of the platform and a second non-upright position for providing barrier-free access back and forth across said ramp means.

4. The device of claim 3 further including a manually releasable lock coupled between said pivotal side railing means and said platform to fixedly hold said pivotal side railing means in said first upright position.

5. The device of claim 3 further including mounting means attached below the top surface of said platform for pivotally mounting said side railing means to allow said side railing means to be in said second non-upright position without any portion of said mounting means and said side railing means protruding above the top surface of said platform.

6. The device of claim 3 further including a footrest mounted on the front of said frame structure spaced below the front edge of said platform, and wherein said fixed front railing means includes a bar extending horizontally along the front edge of the platform, said bar having a raised portion adjacent said toilet cutout and said footrest to allow sufficient clearance for the legs of a patient seated on the commode.

7. The device of claim 3 wherein said upright means includes a single support bar connected between said front railing means and said platform thereby leaving sufficient lateral clearance for both legs to move under the front railing means.

8. The device of claim 7 wherein said single support bar is connected between said front railing means and said platform on one side of said platform thereby leaving sufficient lateral clearance for right and left legs together to swing from the opposite side of said platform and under said front railing means.

9. The device of claim 7 wherein said single support bar is centrally mounted on said platform thereby leaving sufficient clearance for right and left legs to move under the front railing means to straddle said upright support.

10. The device of claim 3 wherein said upright means includes peripheral means supporting said front railing means solely at its ends thereby leaving sufficient central clearance for right and left legs to move under the front railing means between said peripheral upright means.

11. A mobile bedside commode comprising in combination:

a frame structure;

fastener means on said frame structure for removeably securing the commode to an adjacent bed;

a platform attached on top of said frame structure and including a toilet cutout and means for holding a toilet bowl underneath said cutout;

ramp means pivotally attached to a back edge of said platform to rest on the adjacent top surface of the bed for providing a bridge between the bed and said platform;

a horizontal railing attached on one side of the front edge of said platform and raised enough to allow clearance for the legs of a patient seated on the commode; and a peripheral railing along each side edge of said platform and including pivotal mounting means for moving one of said peripheral railings from a first upright locked position to a second unlocked position below the surface of the platform, whereby a patient can manipulate at least one of said peripheral railings between locked and unlocked positions and use said horizontal and peripheral railings to pull himself across said ramp means between the bed and the commode.

12. The device of claim 11 wherein one of said peripheral railings is rigidly mounted in an upright position.

13. The device of claim 11 wherein said horizontal railing includes a bar having only a single support bar displaced from the toilet cutout and connecting said horizontal railing to said platform and including auxiliary flange means for receiving mounting bolts attached to said platform.

14. The device of claim 12 wherein said horizontal railing is attached to said rigidly mounted peripheral railing to constitute a lateral extension thereof, thereby eliminating the need for a separate support for said horizontal railing.

15. The device of claim 11 wherein said ramp means includes a solid rectangular member manually movable from a retracted storage position off the bed to a laterally extending operational position on the bed.

16. A mobile bedside commode having a support frame carrying a platform at a fixed height and fastener means for holding the frame in position adjacent to a bed, wherein the improvement comprises:

ramp means hingedly attached along the back of the platform with free longitudinal edge means for resting on the bed to provide a bridge from the bed to the platform; and bar means mounted on the front and sides of the platform including a first side bar fixedly mounted on one side of said platform, and second side bar means mounted on another side of said platform for enabling manual movement from a fixed raised position above the surface of the platform to a lowered position below the surface of the platform, and front bar means fixedly mounted on said front of the platform with a rised horizontal portion to allow lateral movement of a person's legs thereunder in the course of moving to, using, and moving away from the commode.

* * * * *